US010428439B2

(12) United States Patent
Haehn et al.

(10) Patent No.: US 10,428,439 B2
(45) Date of Patent: Oct. 1, 2019

(54) PREDICTIVE CAPABILITY FOR ELECTROPLATING SHIELD DESIGN

(71) Applicant: Intel Corporation, Santa Clara, CA (US)

(72) Inventors: Nicholas S. Haehn, Scottsdale, AZ (US); Sashi S. Kandanur, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 804 days.

(21) Appl. No.: 14/942,749

(22) Filed: Nov. 16, 2015

(65) Prior Publication Data

US 2017/0140076 A1 May 18, 2017

(51) Int. Cl.

| | |
|---|---|
| ***G06F 17/50*** | (2006.01) |
| ***C25D 17/00*** | (2006.01) |
| *C25D 7/00* | (2006.01) |

(52) U.S. Cl.

CPC ..... *C25D 17/008* (2013.01); *C25D 7/005* (2013.01)

(58) Field of Classification Search

CPC ..... C25D 17/008; C25D 7/005
USPC ..... 703/2
See application file for complete search history.

(56) References Cited

U.S. PATENT DOCUMENTS

2006/0124454 A1* 6/2006 Wurm ..... C25D 17/10 204/286.1
2008/0027691 A1* 1/2008 Kobayashi ..... G05B 13/042 703/6

* cited by examiner

*Primary Examiner* — Dwin M Craig
(74) *Attorney, Agent, or Firm* — Schwabe, Williamson & Wyatt, P.C.

(57) ABSTRACT

A method including running a simulated plating process on a substrate using a base shield, the base shield including a plurality of openings therethrough defining an array including two coordinates; after running the simulated plating process, determining if a predetermined criterion for the simulated plating process is satisfied; and if the predetermined criterion is not satisfied, adjusting one or more of the plurality of openings. A machine readable medium including program instructions that when executed by a controller cause the controller to perform a method including running a simulated plating process on a substrate using a base shield, the base shield including a plurality of openings therethrough defining an array including two coordinates; after running the simulated plating process, determining if a predetermined criterion for the simulated plating process is satisfied; and if the predetermined criterion is not satisfied, adjusting one or more of the plurality of openings.

12 Claims, 3 Drawing Sheets

PREDICTIVE CAPABILITY FOR ELECTROPLATING SHIELD DESIGN

FIELD

Electroplating processes including electroplating of integrated circuit chips and packages.

BACKGROUND

One technique for forming conductive lines or traces is to place a substrate or panel such as an integrated circuit package substrate or a panel into a tank with a plating solution. Also in the tank is an electrode (e.g., an anode). The anode and the panel are connected to a power source that causes the movement of ions in the solution to be plated on the panel. In one technique, an insulating electroplating base shield is placed between the anode and the panel. The shield functions to modulate the electric field in an attempt to produce a more uniform plating of a material (e.g., copper) on the panel. A shield typically has a number of openings therethrough, the openings defining an array or grid having a two-dimensional coordinate system. The placement of the openings in the shield is generally done by an experimental approach in which a starting shield, typically of an arbitrary distribution of uniformly spaced holes, is inserted into the plating bath. A test product is plated and a finite number of point thicknesses are subsequently measured. Based on the limited information about the thickness distribution of plated material across the panel, tape or blocking material is placed over various regions (over various existing openings) and/or new openings are added to the shield in order to alter a thickness distribution across the panel. This altered shield is then re-inserted into the plating bath and a new test panel is plated and measured. This process is repeated until a sufficiently uniformed distribution is obtained. Such experimental trial and error solutions can take as many as ten iterations and one or two months or more.

DETAILED DESCRIPTION

A method is described for an electroplating shield design to provide improved electroplating uniformity across products, such as packaging substrates, circuit structures, or other electroplated substrates. In one embodiment, a method includes running a simulated plating process on a substrate (e.g., a package substrate or panel) using a base shield between the substrate and an anode in a bath, the base shield comprising a plurality of openings therethrough defining an array comprising a two coordinates of a coordinate system. After running the simulated plating process, the method includes determining if a predetermined criterion such as plating thickness or current density for the simulated plating process is satisfied. If the predetermined criterion is not satisfied, one or more of the plurality of openings in the base shield may be adjusted such as by adjusting the size, orientation or location of the opening. In one embodiment, the one or more openings are adjusted based on a result of an algorithm related to the predetermined criterion. In one embodiment, the costly and time intensive experimental iterations done according to known techniques are foregone in lieu of modeling simulations using an algorithm conducted in a virtual environment for designing the opening distribution of the shield. In this manner, one or a number of iterations may be conducted to find a desired (e.g., optimal) shield configuration to improve the uniformity of a metal deposition on a substrate. In one embodiment, each virtual iteration includes a numerical simulation and a refinement of both the size or dimensions and location (x, y dimensions) of openings in the shield. An iteration process in a virtual numerical environment provides a better performing shield with only a single physical iteration on the shield build and testing.

Figure 1:
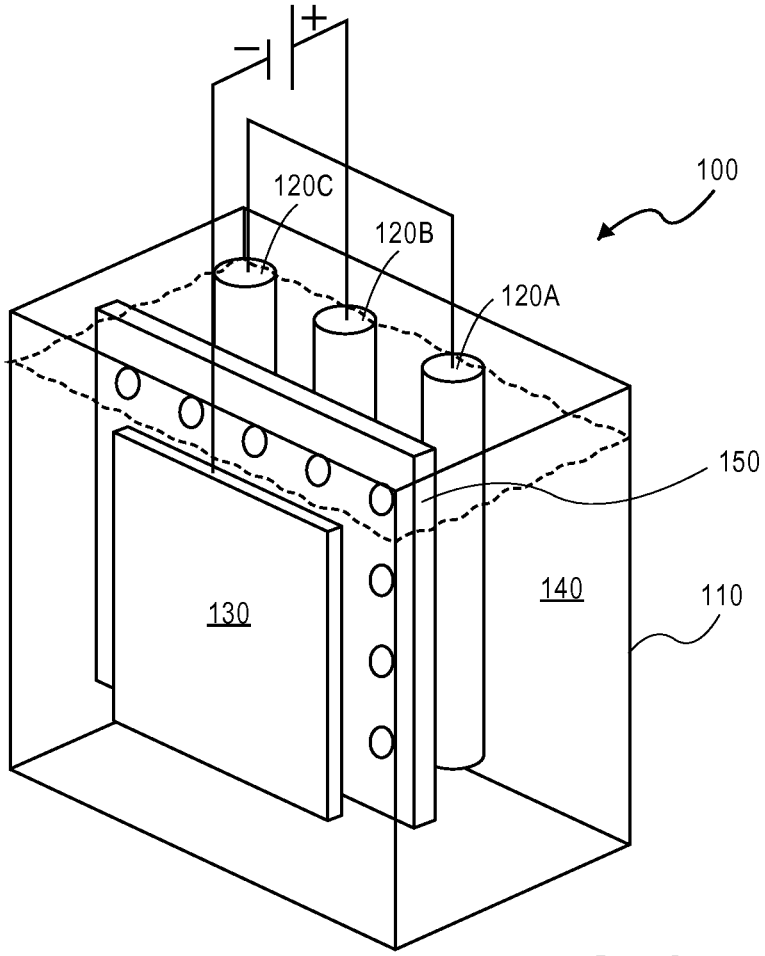
FIG. 1 shows a top, side perspective view of an electroplating assembly.

FIG. 1 illustrates a top, side perspective view of an electroplating assembly. Representatively, assembly 100 includes tank 110 having a volume therein size to accommodate a substrate, such as a portion of a package substrate or substrates (e.g., multiple substrate portions prepared from a common substrate that is later singulated), and an anode and base shield. For a point of reference, a representative package substrate or panel has dimensions on the order of approximately 500 millimeters (mm) by 500 mm by less than 1 mm. Disposed within a volume of tank 110 are, in this embodiment, three cylindrical anodes 120A, 120B and 120C. Also disposed in tank 110 is substrate 130, that is, for example, a portion of a package substrate to which conductive lines or traces are to be plated. A volume of tank 110 includes electroplating solution 140 that is, representatively, a copper ion solution. Disposed between anodes 120A-120C and substrate 130 is base shield 150. Representative dimensions for a base shield in a tank with a package substrate is on the order of 650 mm by 600 mm by 6 mm. Base shield 150 is shown including a number of openings therethrough defining an array having a two-dimensional coordinate system. Base shield may or may not extend to the edges of the tank side walls as needed to improve uniformity. A representative starting shield opening configuration may consist of circular holes with approximately 3-15 mm diameters in an array of approximately 20×20 totaling about 300-400 holes per shield. As representatively illustrated, anodes 120A-120C are connected to a power source (e.g., a battery) as is substrate 130.

Figure 2:
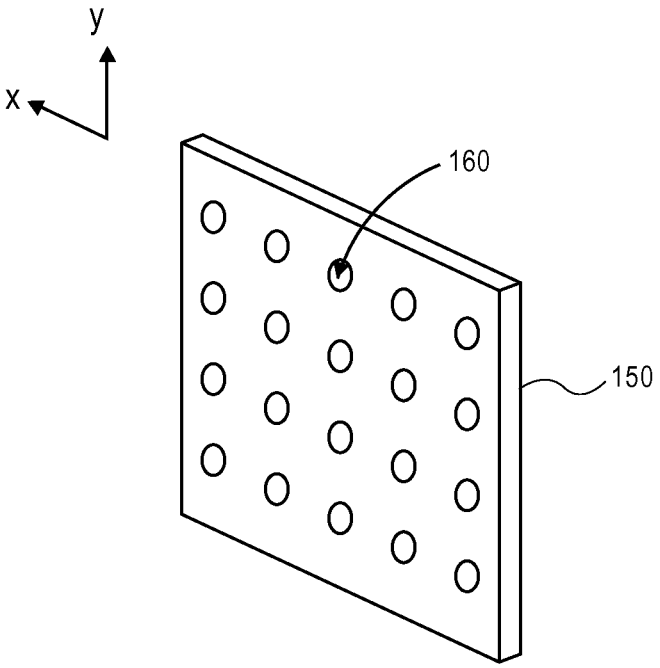
FIG. 2 shows a top, side perspective view of the electroplating base shield in the assembly of FIG. 1.

FIG. 2 shows a topside perspective view of base shield 150. Base shield 150 includes a number of openings 160 therethrough. The openings are laid out, in one embodiment, as an array or grid having a two-dimensional coordinate system (an x- and y-coordinate system). In one embodiment, a method is described for adjusting the size and location of each opening based upon simulation data of an electroplating criterion such as plating thickness to achieve a target pre-determined criterion such as plating thickness.

Figure 3:
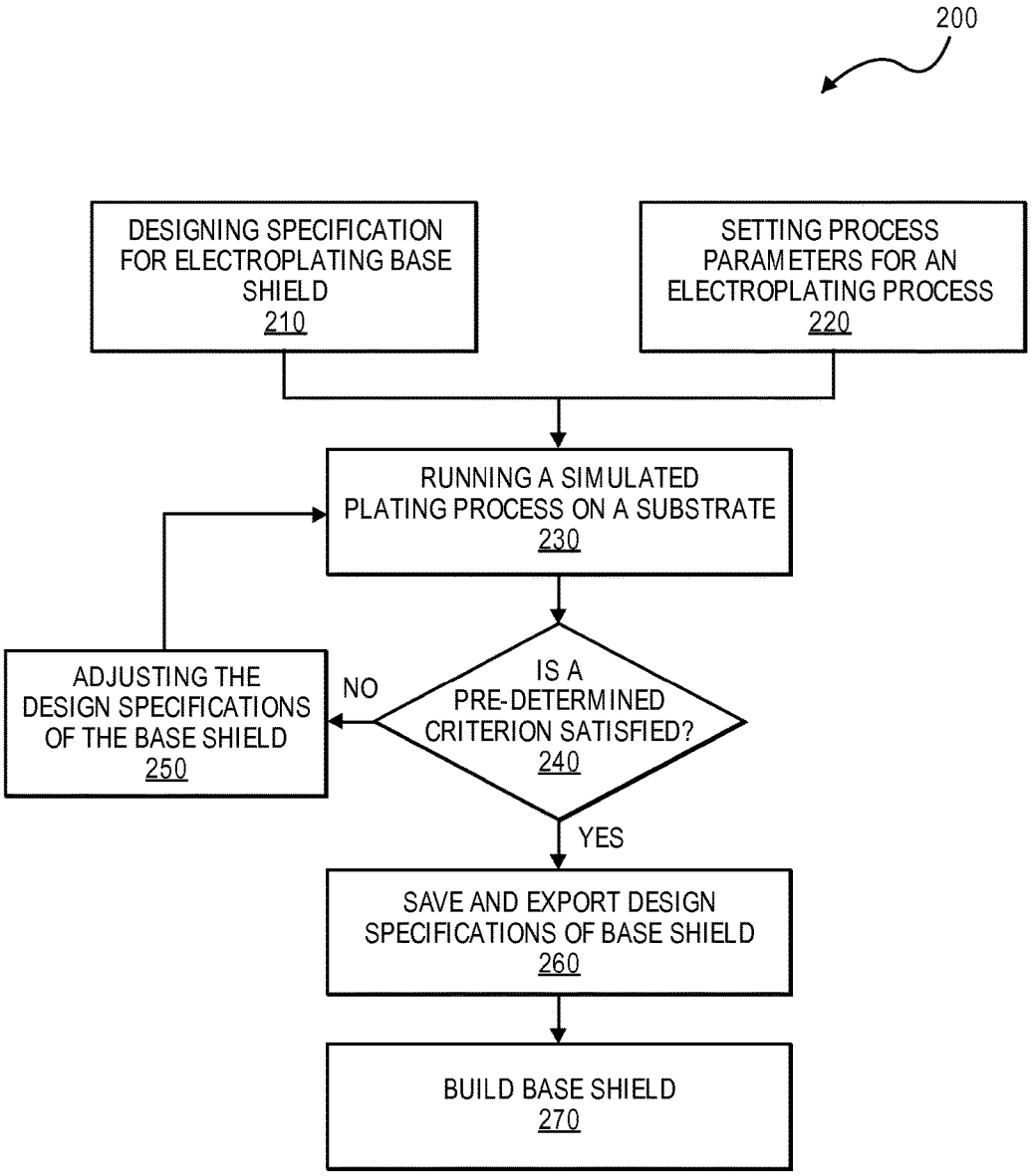
FIG. 3 shows a flow chart of a process for constructing a base shield for an electroplating process.

FIG. 3 shows a flow chart for a process or method according to an embodiment. The method in one embodiment is controlled by non-transitory machine-executable instructions that reside, for example, in machine-usable media of a computer. Such a computer also contains, in one embodiment, accessible memory to store data to be accessed by the machine-readable instructions or to store data generated by the instructions. Referring to FIG. 3, process 200 includes designing a specification for an electroplating base shield (block 210). In one embodiment, such design includes the number, diameter, and location of openings in the base shield (e.g., openings 160 in base shield 150 in FIG. 2). Such data regarding the design of the base shield may be input into the computer along with process parameters set for an electroplating process (block 220). Such process parameters include, but may not be limited to, tank geometry, electroplating solution content and volume, anode geometry, etc. for a simulation. The design specifications for the electroplating base shield and the process parameters for an electroplating process are input into a simulation software stored on the computer, such as COMSOL Multiphysics® modeling software, commercially available from Comsol AB of Stockholm, Sweden. Method 200 then provides running a simulated plating process on a substrate using the design specification for the base shield and the set process parameters for an electroplating process (block 230). The execution of the simulation produces a solution that is, for example, a plated substrate. Parameters of the plated substrate are then analyzed for one or more pre-determined criteria. Method 200 then evaluates whether a pre-determined criterion is satisfied (block 240). An example of a pre-determined criterion is plating thickness. If the pre-determined criterion is not satisfied, the design specification of the base shield are adjusted (block 250). Notably, the dimensions or size and location (x, y coordinates) of openings in the base shield are adjusted. Following the adjustment, a simulated plating process is run using the adjusted design specifications of the base shield. The process continues until the pre-determined criterion is satisfied. Once the pre-determined criterion is satisfied, the design specifications of the base shield are saved into memory and exported (block 260). From the exported design specifications, a physical base shield may be constructed for use in an electroplating process (block 270). Such process in one embodiment may include electroplating conductive lines or traces of a package substrate such as substrate 130 in FIG. 1.

In the above embodiment, the design specifications of a base shield are adjusted following a simulated plating process. The following example describes one example of an algorithm for adjusting the design specifications of the base shield.

EXAMPLE

Data regarding the simulated electroplated film in an active region of the substrate is identified. This is referred to as the test solution, f=f(x,y). Typically, f(x,y)=plating thickness in microns (μm). Discrete solution data nodes will be indexed by j.

Coordinates and diameters of each shield opening are read into a software program such as Matlab. Discrete shield holes are indexed by i.

Each solution data location, j, is mapped to the nearest shield opening location (projected onto a substrate surface). Therefore, each shield hole, i, has a set of solution data values (this could be an empty set in which case the shield opening will not undergo any changes during adjusting).

A. Updating the Shield Opening Diameters:

During each iteration, a diameter of each opening is adjusted based on the local solution information. To determine the adjustment, a solution average or mean or global average or mean is calculated across the active region of the substrate:

$$\bar{f} = \frac{1}{N_j}\sum_j f_j.$$

At each shield location, i, the corresponding solution sets, j in i, are used to calculate the local mean according to:

$$\bar{f}_i = \frac{1}{N_i}\sum_{j\in i} f_i,$$

where Ni is the number of discrete solution nodes contained in the set for shield opening i.

The diameter of each opening is then adjusted based upon the relative difference between each shield opening set mean (local mean) and the full solution mean (global mean), or:

$$\Delta f_i = \tilde{f}_i - \tilde{f}.$$

Before adjusting the diameter of each opening, this relative difference is normalized according to:

$$\tilde{f}_i = \frac{\Delta f_i}{\max(|\tilde{f}_i - \tilde{f}|)}.$$

Now, the area of each shield opening is adjusted by:

$$A_{new,i} = [-\tilde{f}_i \cdot (gr-1)+1] \cdot A_{old,i}$$

where, gr, is a growth rate factor that is typically between 1 and 1.5, and $A_{old,i}$ is the prior opening area that was either estimated (first instance) or previously adjusted.

B. Updating the Opening Coordinates:

To adjust the x- and y-coordinates of the openings in the base shield, a gradient of the solution is calculated at the coordinates of each shield opening location (xi, yi) as:

$$\nabla \bar{f}_i = \frac{\partial f}{\partial x}\hat{x} + \frac{\partial f}{\partial y}\hat{y}.$$

Then, similar to the opening diameters, the individual components of the gradient are normalized and used to update the (xi, yi) coordinates according to:

$$\hat{\partial} f_x = \frac{\frac{\partial f}{\partial x}}{\max\left(\left|\frac{\partial f}{\partial x}\right|\right)} \text{ and } \hat{\partial} f_y = \frac{\frac{\partial f}{\partial y}}{\max\left(\left|\frac{\partial f}{\partial y}\right|\right)}.$$

Such that, $$x_{i,new} = x_{i,old} - \hat{\partial} f_x \cdot \Delta_{max}$$

$$y_{i,new} = y_{i,old} - \hat{\partial} f_y \cdot \Delta_{max},$$

where $\Delta_{max}$ is an input parameter, like gr, that sets the maximum displacement that any single shield hole can undergo. In one embodiment, $\Delta_{max}$ may constitute a $\Delta_{max}$ for an x displacement and a $\Delta_{max}$ for a y displacement.

Both gr and $\Delta_{max}$ can be varied during each successive iteration as needed.

The above algorithm has the capability to operate within the physical constraints that are required for actual implementation in different environments. These include, but are not limited to: restricting the spatial extents that shield holes can be drilled; restricting the minimum distance between shield holes; and restricting the shield hole sizes to a predefined allowable set.

Figure 4:
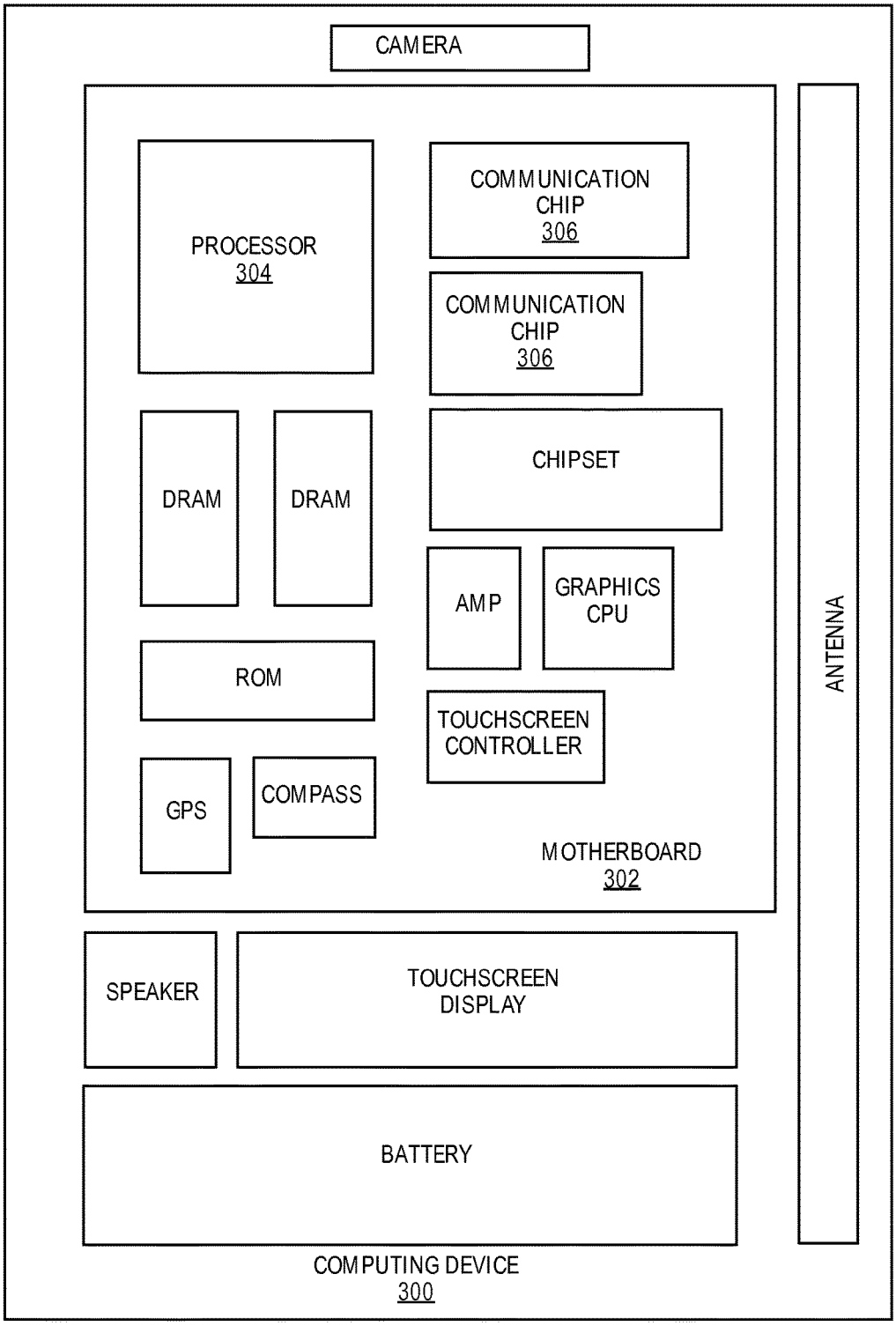
FIG. 4 illustrates an embodiment of a computing device.

FIG. 4 illustrates computing device 300 in accordance with one implementation. Computing device 300 houses printed circuit board 302. Board 302 may include a number of components, including but not limited to processor 304 and at least one communication chip 306. Processor 304 is physically and electrically coupled to board 302. In some implementations at least one communication chip 306 is also physically and electrically coupled to board 302. In further implementations, communication chip 306 is part of processor 304.

Depending on its applications, computing device 300 may include other components that may or may not be physically and electrically coupled to board 302. These other components include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth).

Communication chip 306 enables wireless communications for the transfer of data to and from computing device 300. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. Communication chip 306 may implement any of a number of wireless standards or protocols, including but not limited to Wi-Fi (IEEE 802.11 family), WiMAX (IEEE 802.3 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. Computing device 300 may include a plurality of communication chips 306. For instance, first communication chip 306 may be dedicated to shorter range wireless communications such as Wi-Fi and Bluetooth and second communication chip 306 may be dedicated to longer range wireless communications such as GPS, EDGE, GPRS, CDMA, WiMAX, LTE, Ev-DO, and others.

Processor 304 of computing device 300 includes an integrated circuit die packaged within processor 304. In some implementations, the integrated circuit die of the processor includes one or more devices, such as transistors or metal interconnects, and includes I/O contacts. Processor 304 may be packaged with a package substrate in an assembly, where the package substrate includes conductive lines or traces formed by a plating process using a base shield formed as described herein. The term "processor" may refer to any device or portion of a device that processes electronic data from registers and/or memory to transform that electronic data into other electronic data that may be stored in registers and/or memory.

Communication chip 306 also includes an integrated circuit die packaged within communication chip 306. In accordance with another implementation, the integrated circuit die of the communication chip includes one or more devices, such as transistors or metal interconnects, and includes I/O contacts. Communication chip 306 may be packaged with a package substrate in an assembly, where the package substrate includes conductive lines or traces formed by a plating process using a base shield formed as described herein.

In further implementations, another component housed within computing device 300 may contain an integrated circuit die that includes one or more devices, such as transistors or metal interconnects, and includes I/O contacts. The integrated circuit die may be packaged with a package substrate in an assembly, where the package substrate includes conductive lines or traces formed by a plating process using a base shield formed as described herein.

In various implementations, computing device 300 may be a laptop, a netbook, a notebook, an ultrabook, a smartphone, a tablet, a personal digital assistant (PDA), an ultra mobile PC, a mobile phone, a desktop computer, a server, a printer, a scanner, a monitor, a set-top box, an entertainment control unit, a digital camera, a portable music player, or a digital video recorder. In further implementations, computing device 300 may be any other electronic device that processes data.

The above description included a process for designing an electroplating shield for use in electroplating a substrate that is a package substrate for an integrated circuit chip. It is appreciated that a substrate as used herein is not limited to a package substrate. The techniques for designing a shield can be applied to shields for the plating of substrates of various kinds including but not limited, automobile parts, appliances and consumer goods (e.g., jewelry, razors). Similarly, the design techniques are applicable to various plating materials including but not limited to copper, nickel, chrome and gold. Similarly, while the embodiments describe a shield including a two-dimensional coordinate system (xy), it is appreciated that the methods are applicable for shields defined by other coordinate systems including xyz coordinates.

EXAMPLES

Example 1 is a method including running a simulated plating process on a substrate using a base shield between the substrate and an anode in a bath, the base shield including a plurality of openings therethrough defining an array including a two coordinates; after running the simulated plating process, determining if a predetermined criterion for the simulated plating process is satisfied; and if the predetermined criterion is not satisfied, adjusting one or more of the plurality of openings.

In Example 2, the predetermined criterion of the method of Example 1 includes a thickness of the metal on the substrate.

In Example 3, adjusting the openings of the array in the method of Example 1 includes adjusting at least one of the two coordinates and an area of one or more of the openings.

In Example 4, adjusting the openings of the array in the method of Example 3 includes adjusting each of the two coordinates and an area of one or more of the openings.

In Example 5, the criterion of the method of Example 1 includes a measurable attribute, and adjusting one or more of the plurality of openings of the array includes finding a global average value of the criterion across an active region of the substrate; finding a local average value of the criterion at areas on the substrate; and adjusting an area of each of the plurality of openings based on a difference between the global average value and the local average value.

In Example 6, the local average value of the method of Example 5 is normalized.

In Example 7, areas on the substrate for finding a local average in the method of Example 5 include areas defined by projections from the plurality of openings.

In Example 8, the criterion of the method of Example 1 includes a measurable attribute, and adjusting one or more of the plurality of openings of the array includes finding a local gradient of the criterion at areas on the substrate; normalizing the local gradient; and adjusting a coordinate of each of the openings by the difference of a maximum movement of an opening times the normalized local gradient.

Example 9 is a method including designing specifications for an electroplating base shield including a plurality of openings therethrough defining an array including two coordinates; setting process parameters for an electroplating process using the base shield; running a simulated plating process on a substrate using the designed specifications and the set process parameters; after running the simulated plating process, determining if a predetermined criterion for the simulated plating process is satisfied; and if the predetermined criterion is not satisfied, adjusting one or more of the plurality of openings.

In Example 10, the predetermined criterion of the method of Example 9 includes a thickness of the metal on the substrate.

In Example 11, adjusting the openings of the array of the method of Example 9 includes adjusting at least one of the two coordinates and an area of one or more of the openings.

In Example 12, the criterion of the method of Example 9 includes a measurable attribute, and adjusting one or more of the plurality of openings of the array includes finding a global average value of the criterion across an active region of the substrate; finding a local average value of the criterion at areas on the substrate; and adjusting an area of each of the plurality of openings based on a difference between the global average value and the local average value.

In Example 13, the local average value of the method of Example 12 is normalized.

In Example 14, setting the process parameters of the method of Example 13 includes disposing the base shield between the substrate and an anode and areas on the substrate for finding a local average include areas defined by projections from the plurality of openings.

In Example 15, the criterion of the method of Example 9 includes a measurable attribute, and adjusting one or more of the plurality of openings of the array includes finding a local gradient of the criterion at areas on the substrate; normalizing the local gradient; and adjusting a coordinate of each of the openings by the difference of a maximum movement of an opening times the normalized local gradient.

Example 16 is a machine-readable medium including program instructions that when executed by a controller cause the controller to perform a method including running a simulated plating process on a substrate using a base shield between the substrate and an anode in a bath, the base shield including a plurality of openings therethrough defining an array including two coordinates; after running the simulated plating process, determining if a predetermined criterion for the simulated plating process is satisfied; and if the predetermined criterion is not satisfied, adjusting one or more of the plurality of openings.

In Example 17, the predetermined criterion of the method of Example 16 includes a thickness of the metal on the substrate.

In Example 18, adjusting the openings of the array of the method of Example 16 includes adjusting at least one of the two coordinates and an area of one or more of the openings.

In Example 19, the criterion of the method of Example 16 includes a measurable attribute, and adjusting one or more of the plurality of openings of the array includes finding a global average value of the criterion across an active region of the substrate; finding a local average value of the criterion at areas on the substrate; and adjusting an area of each of the plurality of openings based on a difference between the global average value and the local average value.

In Example 20, the local average value of the method of Example 19 is normalized.

In Example 21, areas on the substrate for finding a local average of the method of Example 20 include areas defined by projections from the plurality of openings.

In Example 22, the criterion of the method of Example 16 includes a measurable attribute, and adjusting one or more of the plurality of openings of the array includes finding a local gradient of the criterion at areas on the substrate; normalizing the local gradient; and adjusting a coordinate of each of the openings by the difference of a maximum movement of an opening times the normalized local gradient.

The above description of illustrated implementations, including what is described in the Abstract, is not intended to be exhaustive or to limit the invention to the precise forms disclosed. While specific implementations of, and examples for, the invention are described herein for illustrative purposes, various equivalent modifications are possible within the scope, as those skilled in the relevant art will recognize. These modifications may be made to the invention in light of the above detailed description. The terms used in the following claims should not be construed to limit the invention to the specific implementations disclosed in the specification and the claims. Rather, the scope is to be determined entirely by the following claims, which are to be construed in accordance with established doctrines of claim interpretation.

What is claimed is:

1. A method of electroplating, comprising:

placing a substrate in a tank comprising a plating solution, an anode, and a base shield, the base shield having a plurality of openings in an array having a two-dimensional coordinate system; and electroplating a material on the substrate, wherein at least one of the number of the plurality of openings, the diameter of the plurality of openings, or the location of the plurality of openings in the base shield is determined by a method comprising:

running a simulated plating process on a substrate using a base shield between the substrate and an anode in a bath, the base shield comprising a plurality of openings therethrough defining an array comprising a two coordinates;

after running the simulated plating process, determining if a predetermined criterion for the simulated plating process is satisfied; and if the predetermined criterion is not satisfied, adjusting one or more of the plurality of openings, wherein adjusting the openings of the array comprises adjusting at least one of the two coordinates and an area of one or more of the openings.

2. The method of claim 1, wherein the predetermined criterion comprises a thickness of the metal on the substrate.

3. The method of claim 1, wherein adjusting the openings of the array comprises adjusting each of the two coordinates and an area of one or more of the openings.

4. The method of claim 1, wherein the criterion comprises a measurable attribute, and adjusting one or more of the plurality of openings of the array comprises:

finding a global average value of the criterion across an active region of the substrate;

finding a local average value of the criterion at areas on the substrate; and adjusting an area of each of the plurality of openings based on a difference between the global average value and the local average value.

5. The method of claim 4, wherein the local average value is normalized.

6. The method of claim 4, wherein areas on the substrate for finding a local average comprise areas defined by projections from the plurality of openings.

7. The method of claim 1, wherein the criterion comprises a measurable attribute, and adjusting one or more of the plurality of openings of the array comprises:

finding a local gradient of the criterion at areas on the substrate;

normalizing the local gradient; and adjusting a coordinate of each of the openings by the difference of a maximum movement of an opening times the normalized local gradient.

8. The method of claim 1, further comprising:

prior to running the simulated plating process, designing specifications for the electroplating base shield; and setting process parameters for an electroplating process using the base shield.

9. A method of electroplating, comprising:

placing a substrate in a tank comprising a plating solution, an anode, and a base shield, the base shield having a plurality of openings in an array having a two-dimensional coordinate system; and electroplating a material on the substrate, wherein at least one of the number of the plurality of openings, the diameter of the plurality of openings, or the location of the plurality of openings in the base shield is determined by a method comprising:

running a simulated plating process on a substrate using a base shield between the substrate and an anode in a bath, the base shield comprising a plurality of openings therethrough defining an array comprising a two coordinates;

after running the simulated plating process, determining if a predetermined criterion for the simulated plating process is satisfied; and if the predetermined criterion is not satisfied, adjusting one or more of the plurality of openings, wherein the criterion comprises a measurable attribute, and adjusting one or more of the plurality of openings of the array comprises:

finding a global average value of the criterion across an active region of the substrate;

finding a local average value of the criterion at areas on the substrate; and adjusting an area of each of the plurality of openings based on a difference between the global average value and the local average value.

10. The method of claim 9, wherein the local average value is normalized.

11. The method of claim 9, wherein areas on the substrate for finding a local average comprise areas defined by projections from the plurality of openings.

12. A method of electroplating, comprising:

placing a substrate in a tank comprising a plating solution, an anode, and a base shield, the base shield having a plurality of openings in an array having a two-dimensional coordinate system; and electroplating a material on the substrate, wherein at least one of the number of the plurality of openings, the diameter of the plurality of openings, or the location of the plurality of openings in the base shield is determined by a method comprising:

running a simulated plating process on a substrate using a base shield between the substrate and an anode in a bath, the base shield comprising a plurality of openings therethrough defining an array comprising a two coordinates;

after running the simulated plating process, determining if a predetermined criterion for the simulated plating process is satisfied; and if the predetermined criterion is not satisfied, adjusting one or more of the plurality of openings, wherein the criterion comprises a measurable attribute, and adjusting one or more of the plurality of openings of the array comprises:

finding a local gradient of the criterion at areas on the substrate;

normalizing the local gradient; and adjusting a coordinate of each of the openings by the difference of a maximum movement of an opening times the normalized local gradient.

* * * * *